US008052402B2

(12) United States Patent
Sanders et al.

(10) Patent No.: US 8,052,402 B2
(45) Date of Patent: Nov. 8, 2011

(54) HAND OPERATED PUMP

(75) Inventors: Scott A. Sanders, Arnold, MO (US); Ayzik Grach, Chesterfield, MO (US)

(73) Assignee: Lincoln Industrial Corporation, St. Louis, MO (US)

( * ) Notice: Subject to any disclaimer, the term of this patent is extended or adjusted under 35 U.S.C. 154(b) by 511 days.

(21) Appl. No.: 12/254,674

(22) Filed: Oct. 20, 2008

(65) Prior Publication Data

US 2010/0098557 A1 Apr. 22, 2010

(51) Int. Cl.
*F04B 19/00* (2006.01)
*F04B 37/00* (2006.01)

(52) U.S. Cl. ..... 417/315; 417/545

(58) Field of Classification Search ..... 417/315, 417/545

See application file for complete search history.

(56) References Cited

U.S. PATENT DOCUMENTS

| | | | | |
|---|---|---|---|---|
| 1,585,628 | A * | 5/1926 | Pfarre | 417/437 |
| 3,612,722 | A | 10/1971 | Neward | |
| 4,565,506 | A * | 1/1986 | Williams | 417/440 |
| 4,954,054 | A * | 9/1990 | Neward | 417/440 |
| 5,011,381 | A * | 4/1991 | Neward | 417/440 |
| D321,927 | S | 11/1991 | Smith | |
| 5,779,105 | A | 7/1998 | Brown | |
| 5,964,577 | A * | 10/1999 | Chuang | 417/63 |
| 6,102,676 | A | 8/2000 | DiCarlo | |
| 6,135,327 | A | 10/2000 | Post | |
| 6,422,832 | B1 * | 7/2002 | Wang | 417/315 |
| 6,558,130 | B1 * | 5/2003 | Chang | 417/63 |
| D478,369 | S | 8/2003 | Chang | |
| 6,736,292 | B2 * | 5/2004 | Grach et al. | 222/262 |
| D495,029 | S | 8/2004 | Hernandez | |
| 6,814,552 | B2 * | 11/2004 | Wu | 417/440 |
| 6,923,348 | B2 * | 8/2005 | Grach et al. | 222/262 |
| 7,040,355 | B2 * | 5/2006 | Wu | 141/38 |
| 7,147,442 | B2 | 12/2006 | Yeh | |
| 2004/0079169 | A1 * | 4/2004 | Wild et al. | 73/861 |
| 2006/0045782 | A1 | 3/2006 | Kretzinger | |
| 2006/0108180 | A1 | 5/2006 | Grach | |
| 2006/0216171 | A1 * | 9/2006 | Hernandez | 417/437 |
| 2007/0237661 | A1 * | 10/2007 | Chen | 417/545 |
| 2008/0202854 | A1 | 8/2008 | Paluncic | |
| 2008/0240944 | A1 | 10/2008 | Arens | |

FOREIGN PATENT DOCUMENTS

EP 1052445 A1 11/2000

* cited by examiner

*Primary Examiner* — Devon C Kramer
*Assistant Examiner* — Joseph Herrmann
(74) *Attorney, Agent, or Firm* — Senniger Powers LLP

(57) ABSTRACT

A hand operated pump for generating negative and positive air pressure. The pump includes a pump body having a pump cylinder and a piston mounted for reciprocation in the cylinder. A selector valve communicates with the cylinder and is moveable between a positive-pressure position and a negative-pressure position. The arrangement is such that operation of an actuator to move the piston through a power stroke when the selector valve is in its negative-pressure position causes the pump to generate negative pressure at an outlet of the pump, and operation of the actuator to move the piston through a power stroke when the selector valve is in its positive-pressure position causes the pump to generate positive pressure at the outlet of the pump. A method of operating such a pump is also disclosed.

18 Claims, 19 Drawing Sheets

HAND OPERATED PUMP

BACKGROUND OF THE INVENTION

This invention relates generally to air pumps, and more particularly to an air pump for generating BOTH positive and negative air pressure.

FIG. 1 shows a conventional air pump 1. The pump includes a pump body 3 comprising a cylinder 5, a piston 7 in the cylinder, and a hand-operated actuator 9 connected to a piston rod 11 for moving the piston 7 in the cylinder through a power stroke. A spring 13 is provided for moving the piston 7 through a return stroke following a power stroke. The pump 1 has a selector valve 15 rotatable between negative-pressure and positive-pressure positions. When the selector valve 15 is in its negative-pressure position, a negative pressure is generated at an outlet 17 of the pump as the actuator 9 is operated to move the piston 7 through a power stroke. When the selector valve 15 is in its positive-pressure position, positive pressure is not generated as the actuator 9 is operated to move the piston through a power stroke. Instead, positive pressure is generated during the return stroke of the piston 7. As a result, the amount of positive pressure generated is limited by the force exerted by the spring 13. This spring force is generally sufficient to generate a maximum positive pressure of about 15 psi. To create a larger positive pressure, it is necessary for the user of the pump to manually push the piston rod 11 to the left to provide a greater motive force to the piston 7.

Accordingly, there is a need for an improved pump design which allows the pump to generate both negative and positive air pressure during the power stroke of pump operation.

SUMMARY OF THE INVENTION

In one embodiment, this invention is directed to a hand operated pump for generating negative and positive air pressure. The pump comprises a pump body including a pump cylinder. A piston is mounted for reciprocation in the pump cylinder. A piston rod is connected to the piston and extends rearward from the piston in the pump cylinder. An actuator is operatively connected to the piston for moving the piston in the pump cylinder through a power stroke, the piston thereafter being movable through a return stroke prior to another power stroke. A selector valve in the pump body communicates with the pump cylinder and is moveable between a positive-pressure position and a negative-pressure position. An outlet in the pump body communicates with the selector valve for applying the negative and positive air pressure to a device in response to operation of the actuator. The selector valve communicates with a front chamber in front of the piston and a rear chamber behind the piston such that operation of the actuator to move the piston through a power stroke when the selector valve is in its negative-pressure position causes the pump to generate negative pressure at the outlet, and operation of the actuator to move the piston through a power stroke when the selector valve is in its positive-pressure position causes the pump to generate positive pressure at the outlet.

In another aspect, this invention is directed to a method of operating a hand pump to generate both negative and positive air pressure. The pump comprising a pump body including a pump cylinder, a piston mounted for reciprocation in the pump cylinder, a selector valve in the pump body communicating with the pump cylinder and moveable between a positive-pressure position and a negative-pressure position, and an outlet in the pump body. The method comprises moving the selector valve to its negative-pressure position and then hand-operating an actuator of the pump to move the piston in the pump cylinder through a power stroke to generate a negative air pressure at the outlet. The piston is movable through a return stroke prior to another power stroke. The method further comprises moving the selector valve to its positive-pressure position and then hand-operating the actuator of the pump to move the piston in the pump cylinder through a power stroke to generate a positive air pressure at the outlet. The piston is movable through a return stroke prior to another power stroke.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
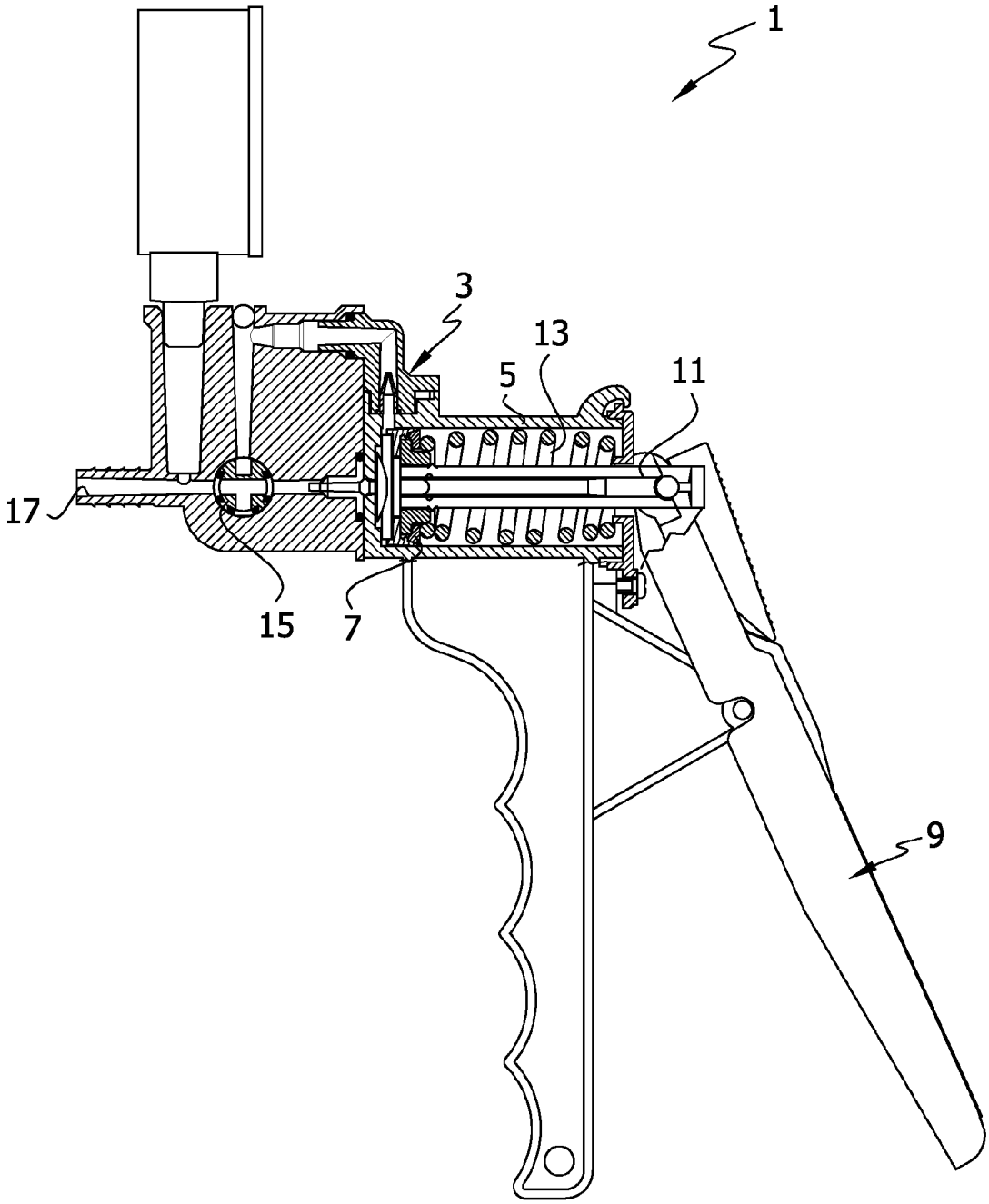
FIG. 1 PRIOR ART
FIG. 1 is a cross sectional elevation of portions of a prior air pump.

FIGS. 2-15 illustrate a first embodiment of a hand operated pump of this invention, designated in its entirety by the reference number 101. The pump is operable for generating positive and negative air pressure. In general, the pump 101 includes a pump body 103 comprising a cylinder 105, a piston 107 mounted for reciprocation in the cylinder, and a piston rod 111 connected to the piston and extending rearward from the piston, generally co-axially with respect to the cylinder. The piston 107 separates the cylinder 105 into a front chamber 119 (see FIG. 14) and a rear chamber 121. A hand operated actuator 109 is connected to the piston rod 111 for moving the piston 107 in the cylinder 105 through a power stroke. The piston moves through a return stroke under the influence of a spring 113 in the rear chamber 121. The pump body 103 also includes a valve housing 123 forward of the pump cylinder 105, forming a front wall 125 of the cylinder.

Figure 4:
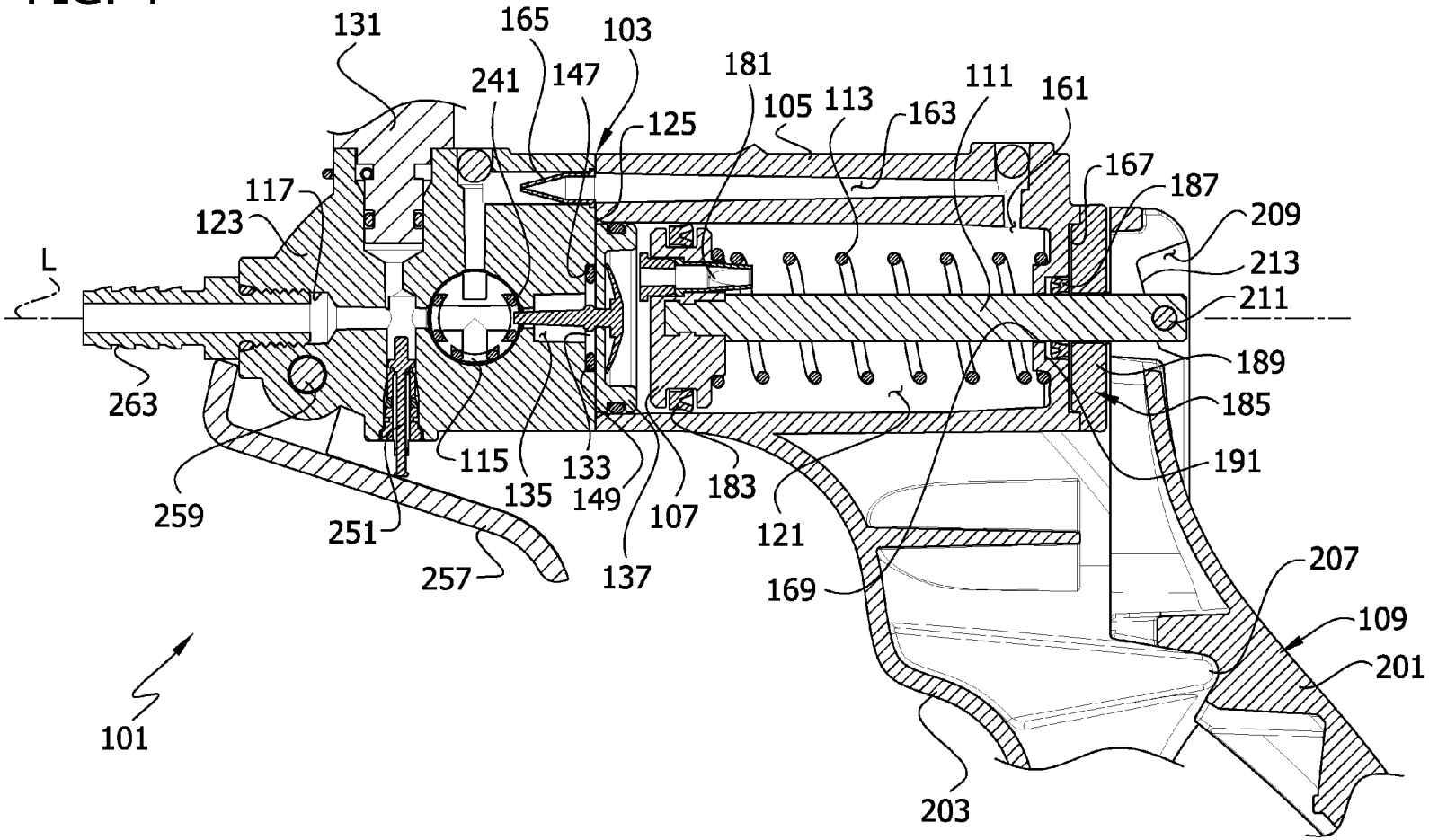
FIG. 4 is a longitudinal section of the air pump with a selector valve of the pump in a negative-pressure position.
Figure 5:
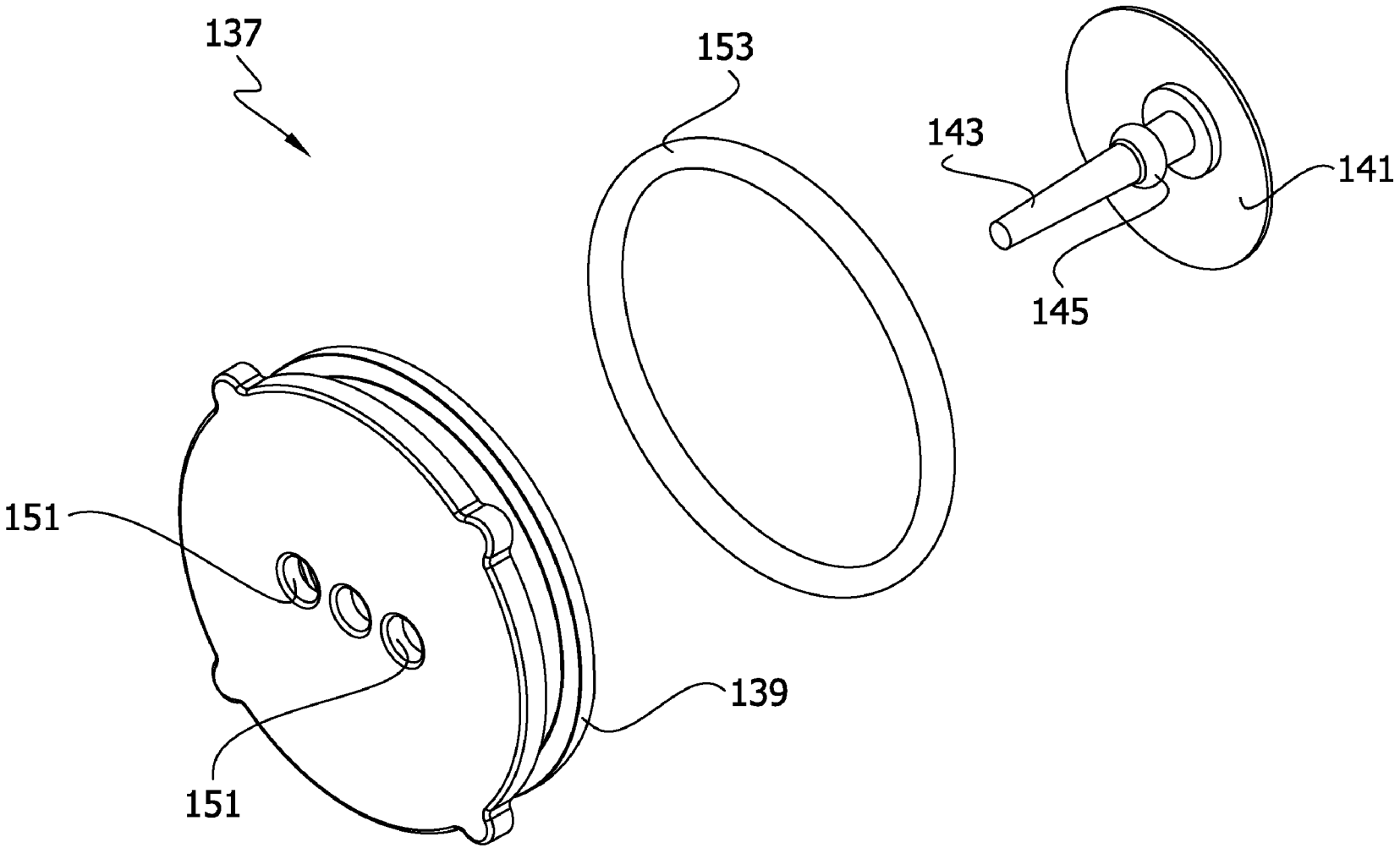
FIG. 5 is an exploded view of a dome check valve assembly.
Figure 13:
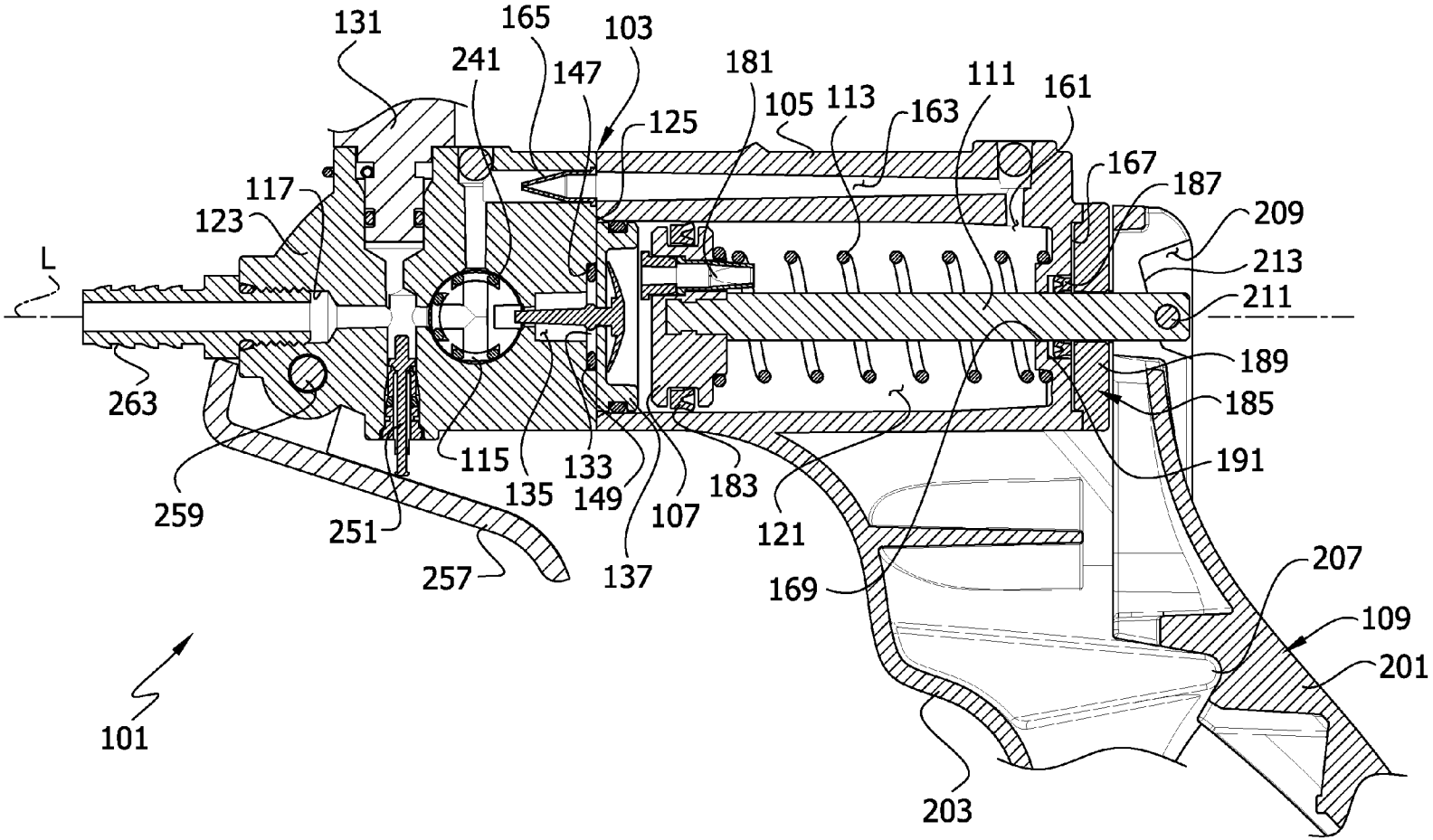
FIG. 13 is a section of the air pump with the selector valve in a positive-pressure position.

A selector valve 115 is mounted for rotation in the housing 123 for movement between a negative-pressure position, shown in FIG. 4, and a positive-pressure position, shown in FIG. 13. The selector valve controls the flow of air between the front and rear chambers 119, 121 of the cylinder and a pump outlet 117 at the front of the valve housing 123. As will be described in detail later, the arrangement is such that the operation of the actuator 109 to move the piston 107 through a power stroke when the selector valve 115 is in its negative-pressure position causes the pump 101 to generate negative pressure at the outlet 117, and operation of the actuator to move the piston through a power stroke when the selector valve is in its positive-pressure position causes the pump to generate positive pressure at the outlet. The positive or negative pressure generated by the pump is applied to a device 127 being tested (e.g., a mechanical engine or an exhaust gas recirculation system) by means of a hose 129 or other suitable conduit attached to the pump outlet 117.

Figure 2:
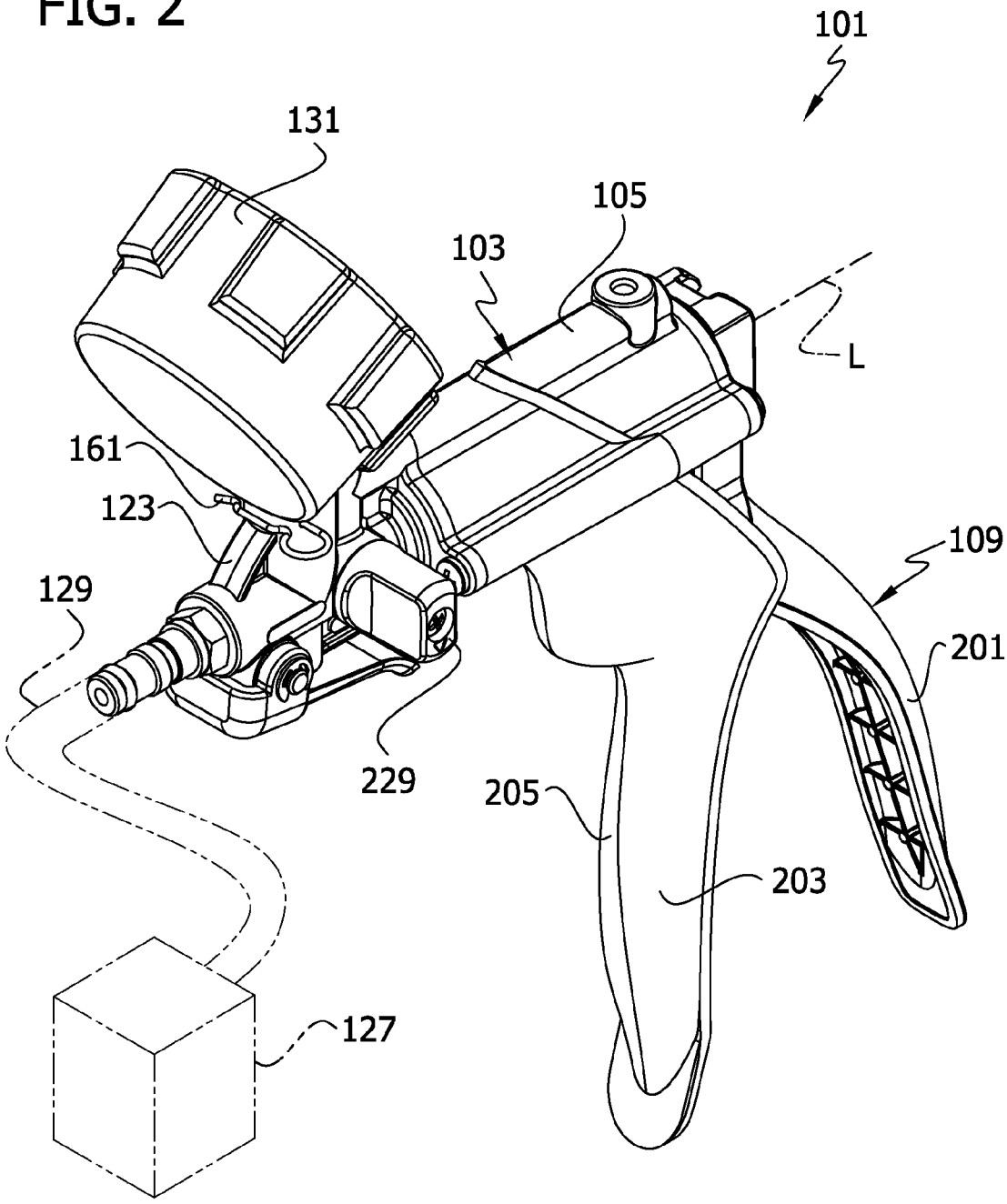
FIG. 2 is a perspective of one embodiment of an air pump of this invention with a hose connection and device being tested shown in phantom.
Figure 2A:
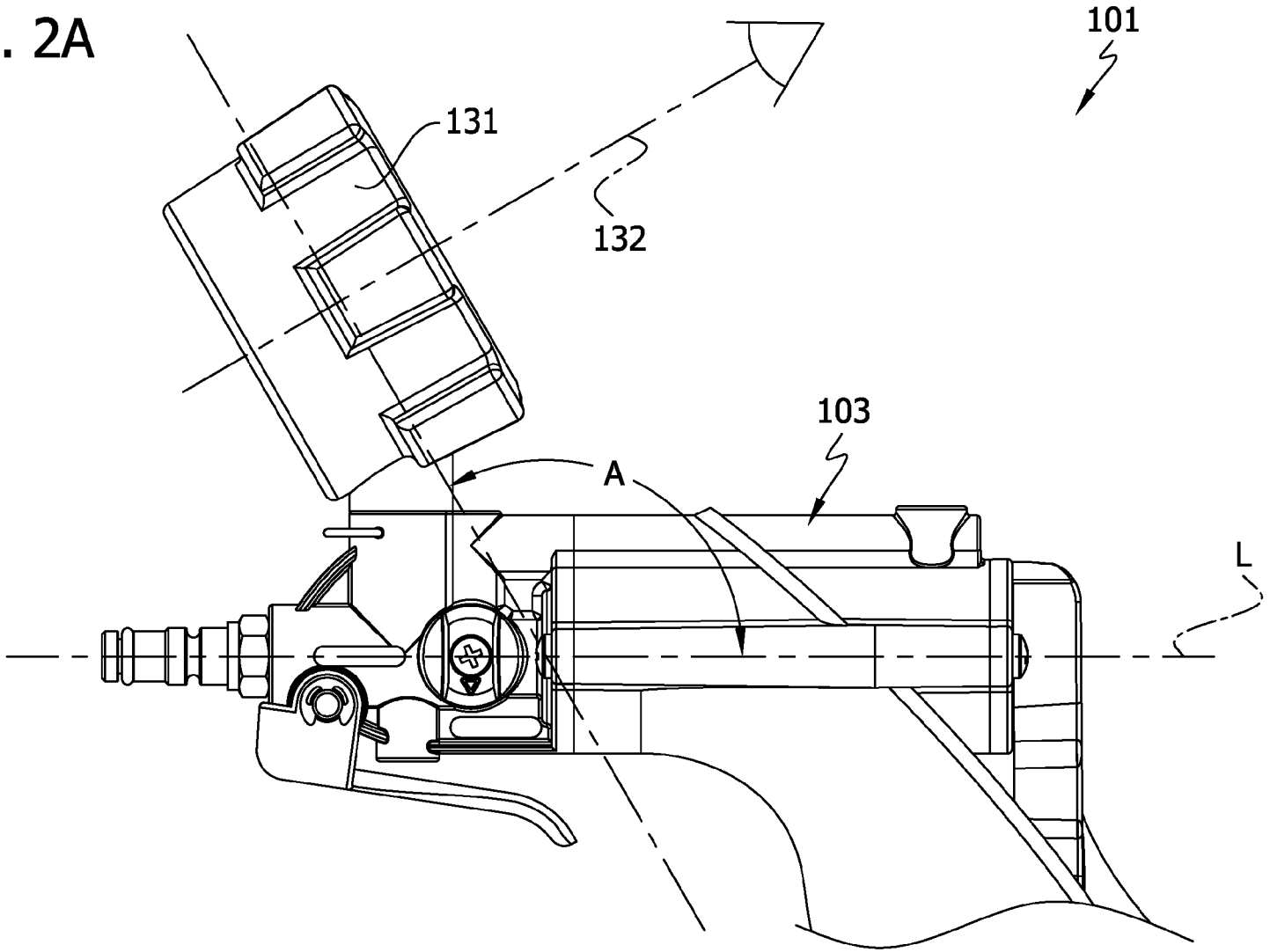
FIG. 2A is a side view of the pump showing a line of sight schematic.
Figure 3:
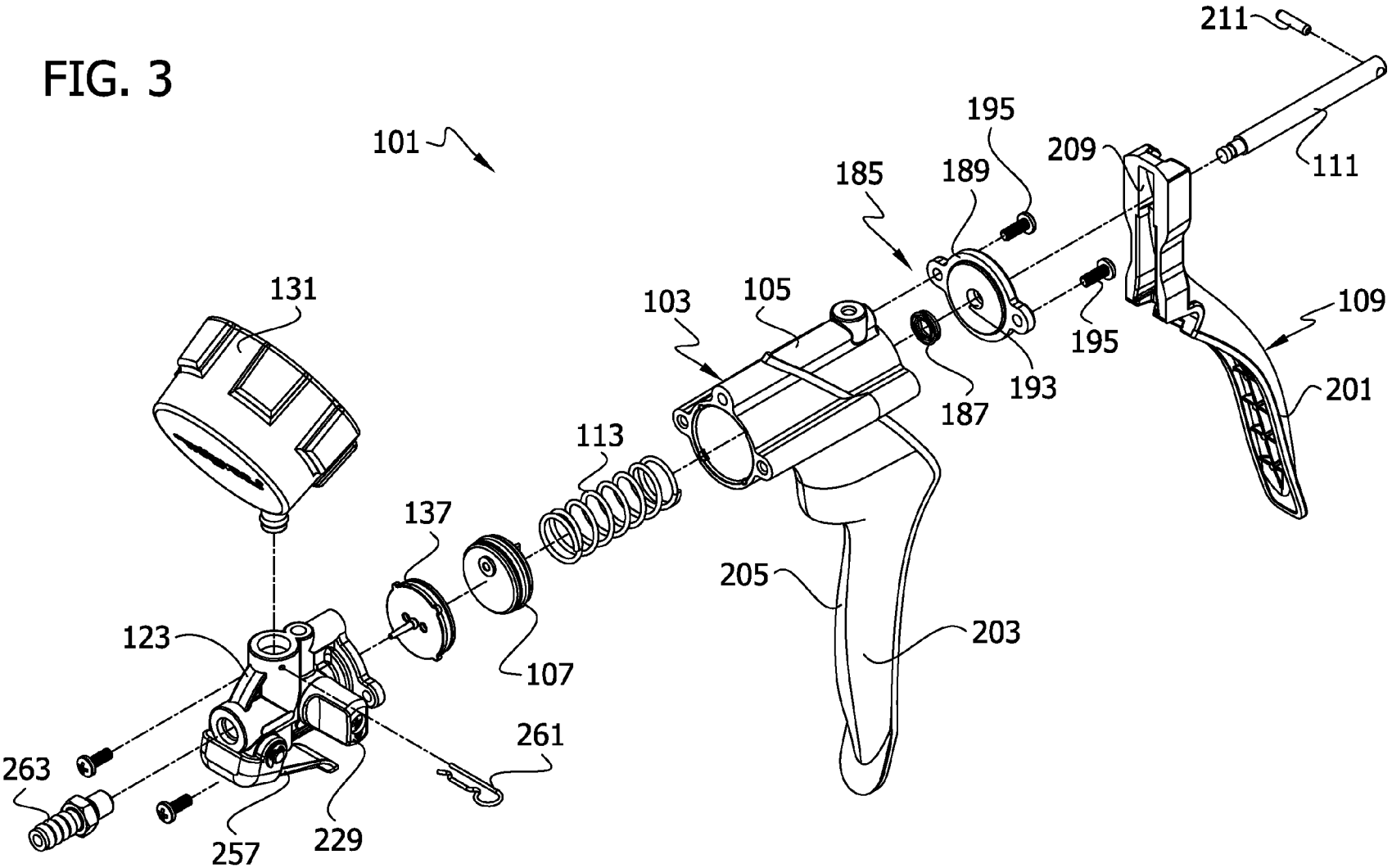
FIG. 3 is an exploded perspective of the air pump of FIG. 2.

A pressure gauge 131 fixed in the valve housing 123 communicates with the outlet 117 for reading the pressure generated by the pump 101. FIG. 2A shows the gauge 131 mounted on the pump body 103 at an obtuse angle A relative to a longitudinal axis L of the pump body. The angle A at which the pressure gauge 131 is mounted is such that the gauge may be readily observed along a line of sight 132 convenient to a person operating the pump. Angle A is desirably in the range of about 110-130 degrees, such as about 120 degrees.

Referring to FIG. 4, the front wall 125 of the cylinder 105 has a front passage opening 133. The opening connects the front chamber 119 of the cylinder 105 with a front chamber passage 135 in the valve housing 123. A check valve assembly 137 in the front chamber 119 regulates air flow through the opening 133. The valve assembly 137 comprises a valve seat 139 and a moveable dome-shaped valve head 141 having a stem 143 extending through the valve seat 139 into the front chamber passage 135 (see FIG. 5). A stop 145 is located on the stem 143. A front O-ring 147 seated in a recess 149 in the front wall 125 seals against the valve seat 139. The seat 139 has two port holes 151 for the flow of air through seat. An O-ring 153 on the seat seals against an inner wall of the cylinder 105.

A rear passage opening 161 is located in the rear chamber 121 of the pump cylinder 105 and opens into a rear chamber passage 163. A duckbill check valve 165 is disposed in the rear chamber passage 163. The cylinder 105 also includes a rear wall 167 having a rear wall opening 169. As will be explained in greater detail below, the selector valve 115 is moveable to selectively connect the front and rear chamber passages 135, 163 with the outlet 117 of the pump.

The piston 107 has an opening receiving a piston check valve 181 configured to open when the piston moves through its return stroke. A piston seal 183 circumscribes the piston 107 and seals against the inner wall of the cylinder 105. A back seal assembly 185 seals around the piston rod 111 for sealing the cylinder 105 against the passage of air out the cylinder through the opening 169 in the rear wall 167 during a power stroke of the piston 107. The back seal assembly 185 includes a back cup seal 187 and a seal retainer 189. The back cup seal 187 is housed in a recess 191 in the rear wall 167 of the cylinder 105. The seal retainer 189 includes a disk member having a circular opening 193. The seal retainer 189 is secured to the cylinder 105 with screws 195. The piston rod 111 passes through the rear wall opening 169 in the cylinder 105 and through the circular opening 193 in the seal retainer 189 for connection to the actuator 109.

Figure 6:
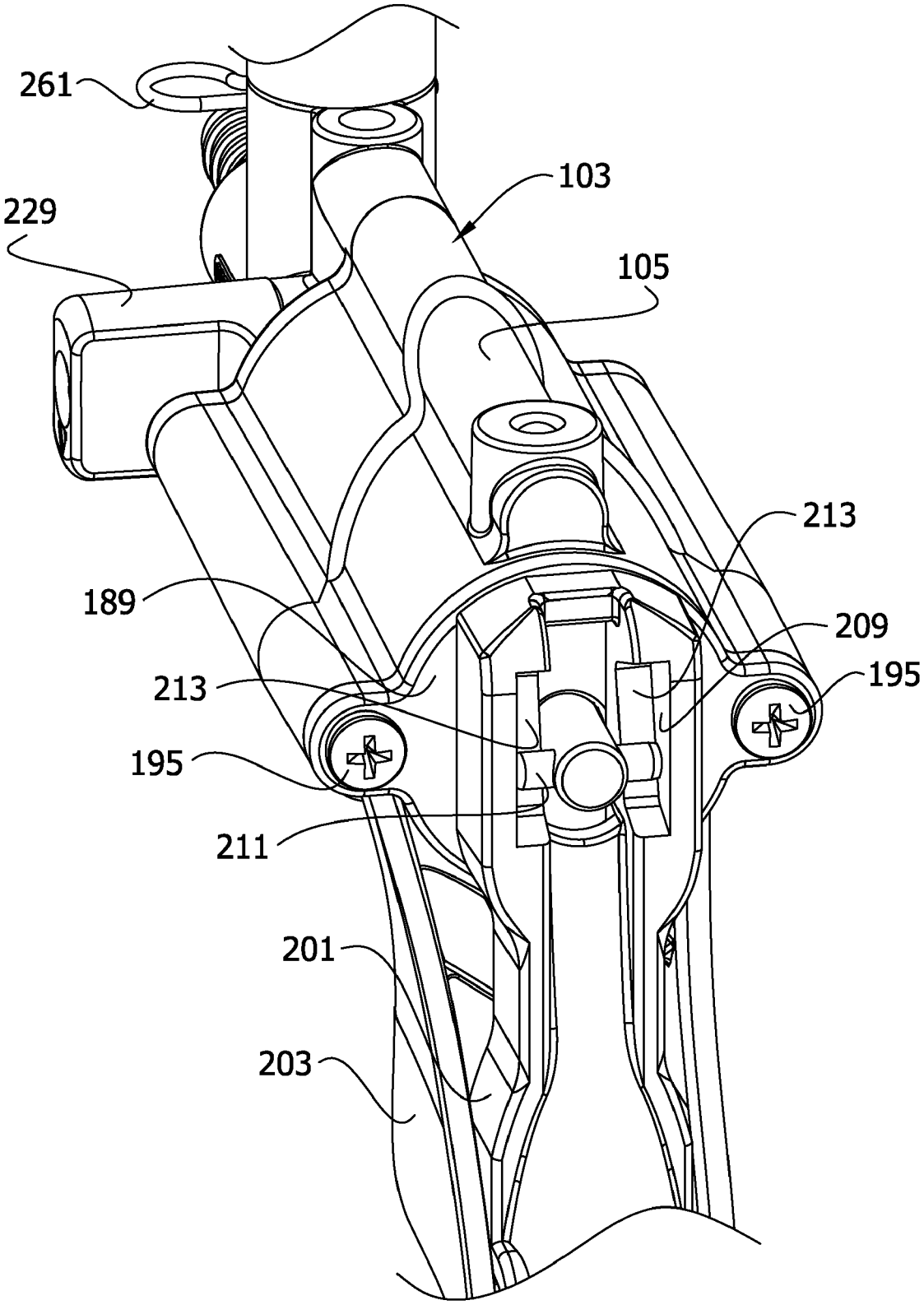
FIG. 6 is a partial rear perspective of the pump.
Figure 7:
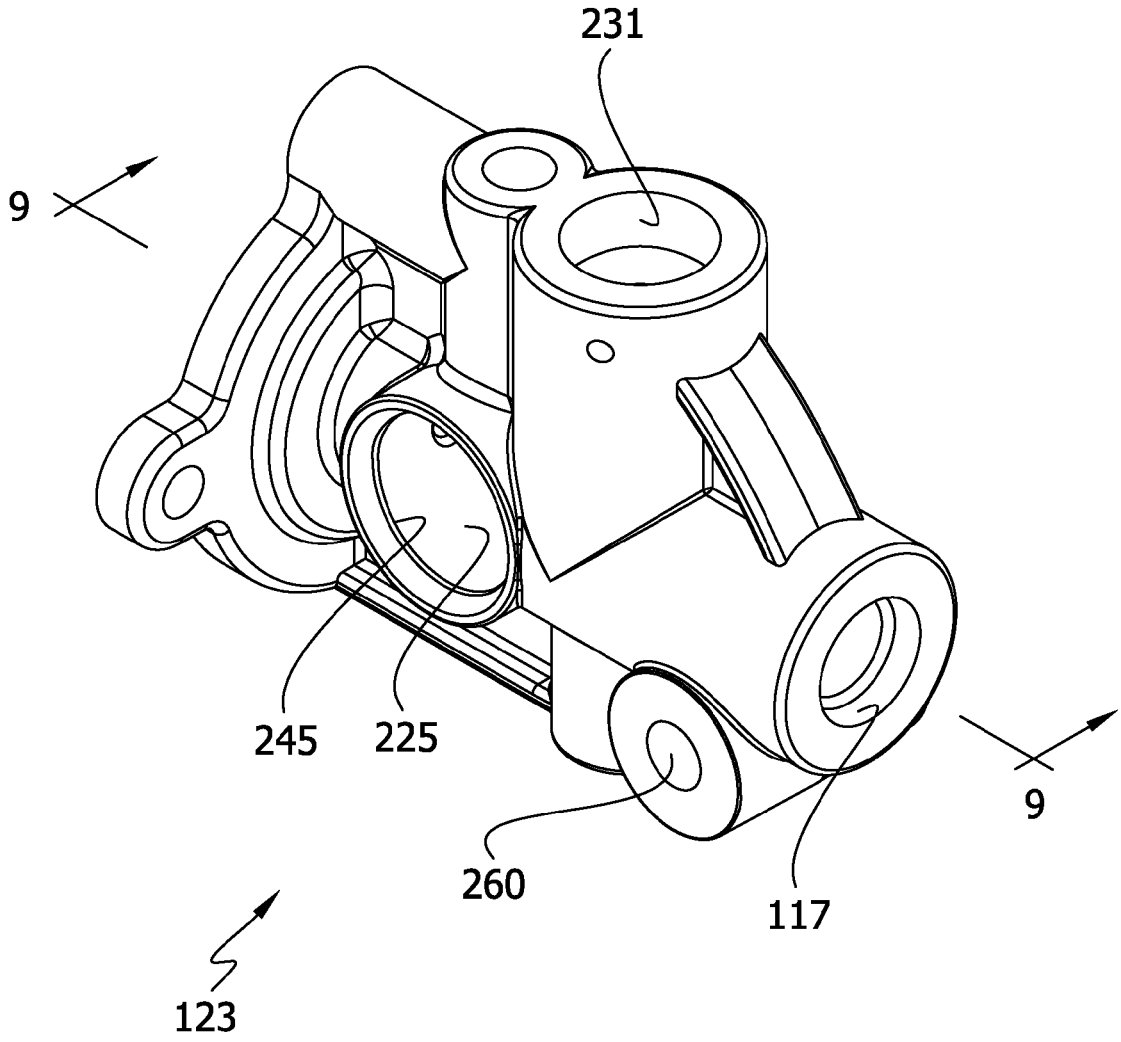
FIG. 7 is a perspective view of a valve housing.

The actuator comprises a pump handle 201 and a hand grip 203. The hand grip is fixedly attached to the underside of the pump cylinder 105. The hand grip 203 has a curved surface 205 to facilitate gripping of the actuator 109. The pump handle 201 pivotally attaches to the hand grip 203 at a pivot location 207. As shown in FIGS. 4 and 6, the back end of the piston rod 111 passes through a recess comprising a vertical slot 209 in the pump handle 201 adjacent its upper end. A rod pin 211 affixed to the rod contacts a pair of ramp surfaces 213 on opposite sides of the slot 209. As will be described in greater detail below, the ramp surfaces 213 move relative to the pin when the handle 201 is operated. As a result, the piston rod 111 remains on the longitudinal axis L of the cylinder, and side loads on the back cup seal 187 and piston 107 are kept to a minimum. It will be understood that the piston rod 111 can be connected to the handle 201 in other ways. For example, the handle and rod could have a fixed pin connection, and the opening in the rear cylinder wall could be sealed with a flexible seal permitting the rod to move transversely with respect to the longitudinal axis L of the pump body.

Figure 8:
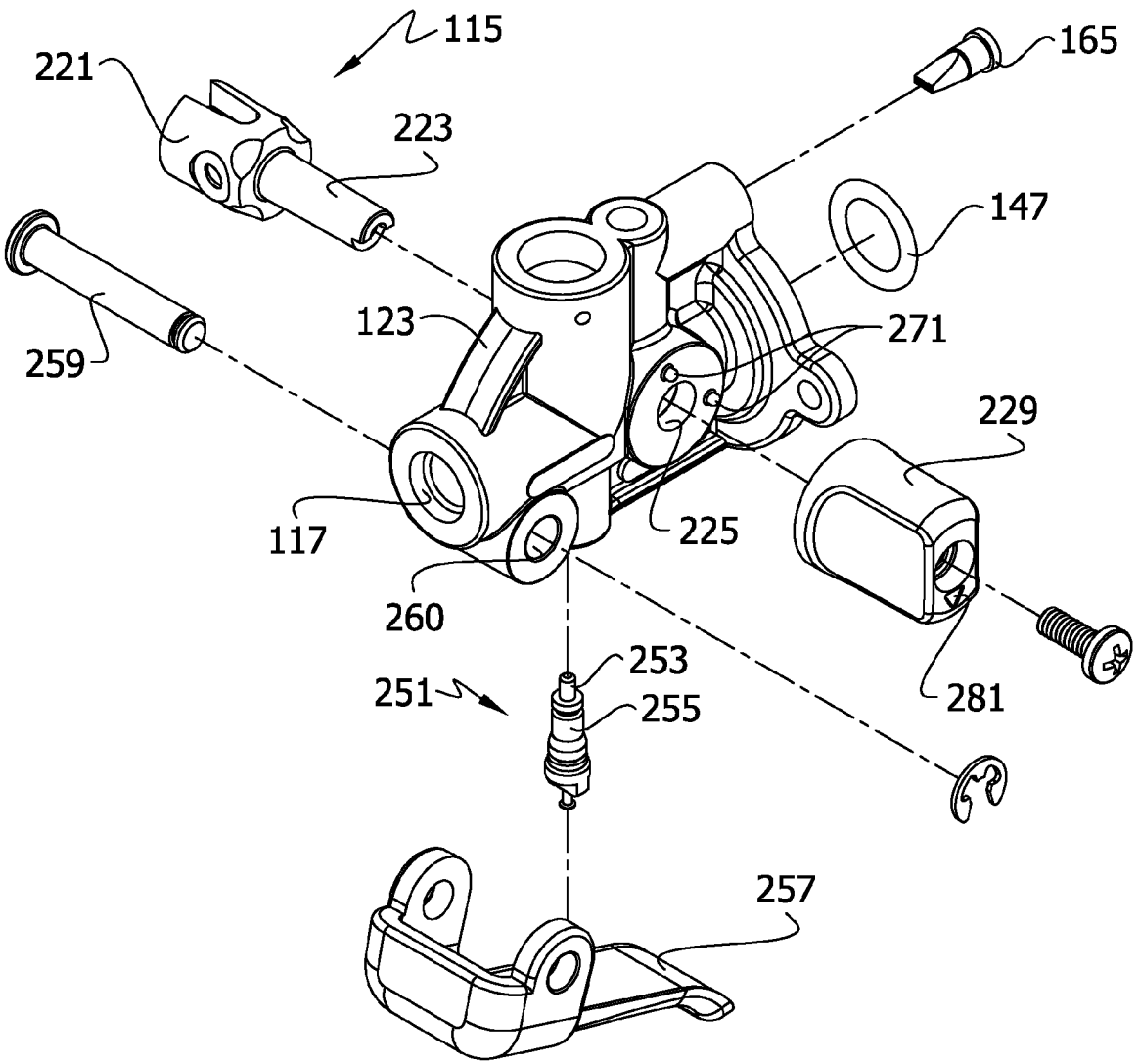
FIG. 8 is an exploded perspective of the valve housing of FIG. 7 and related components.
Figure 8A:
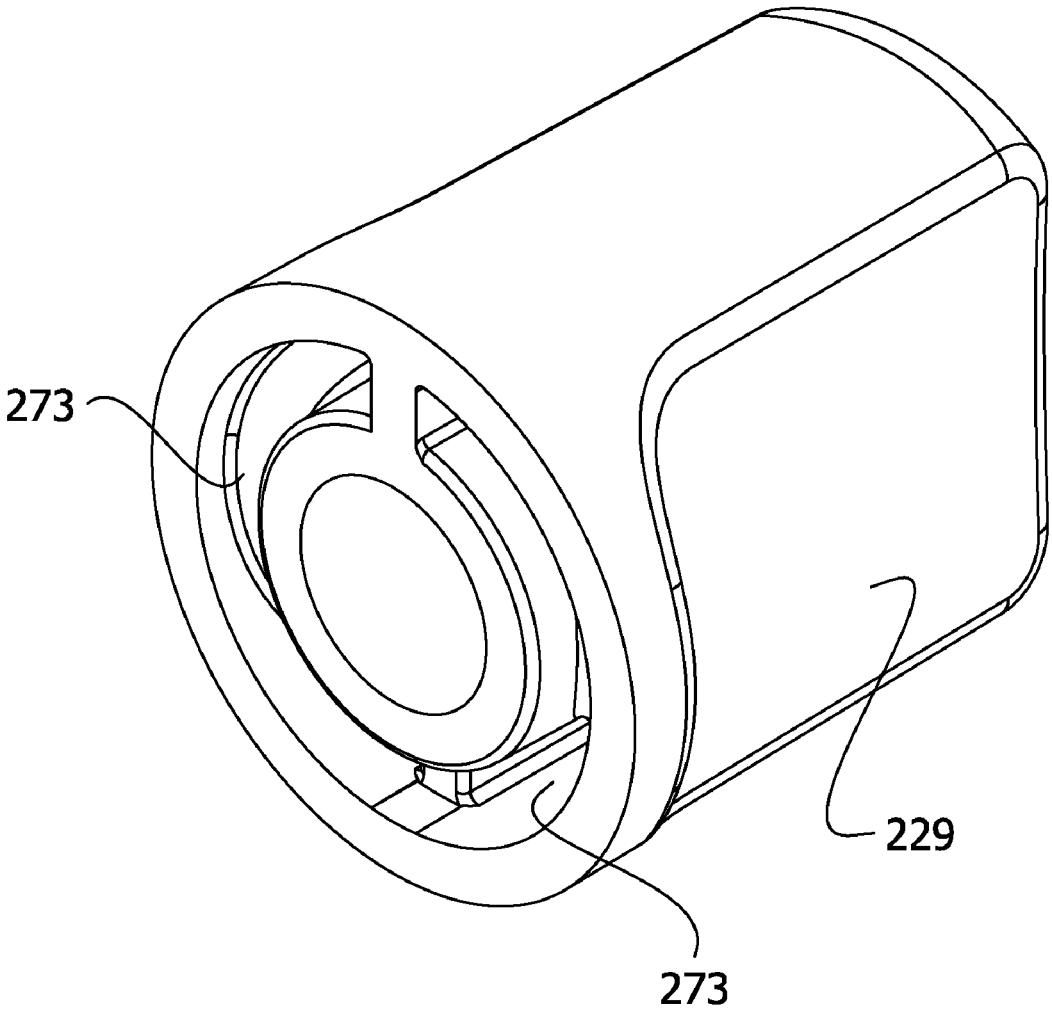
FIG. 8A is a perspective of a knob for moving the selector valve.
Figure 9:
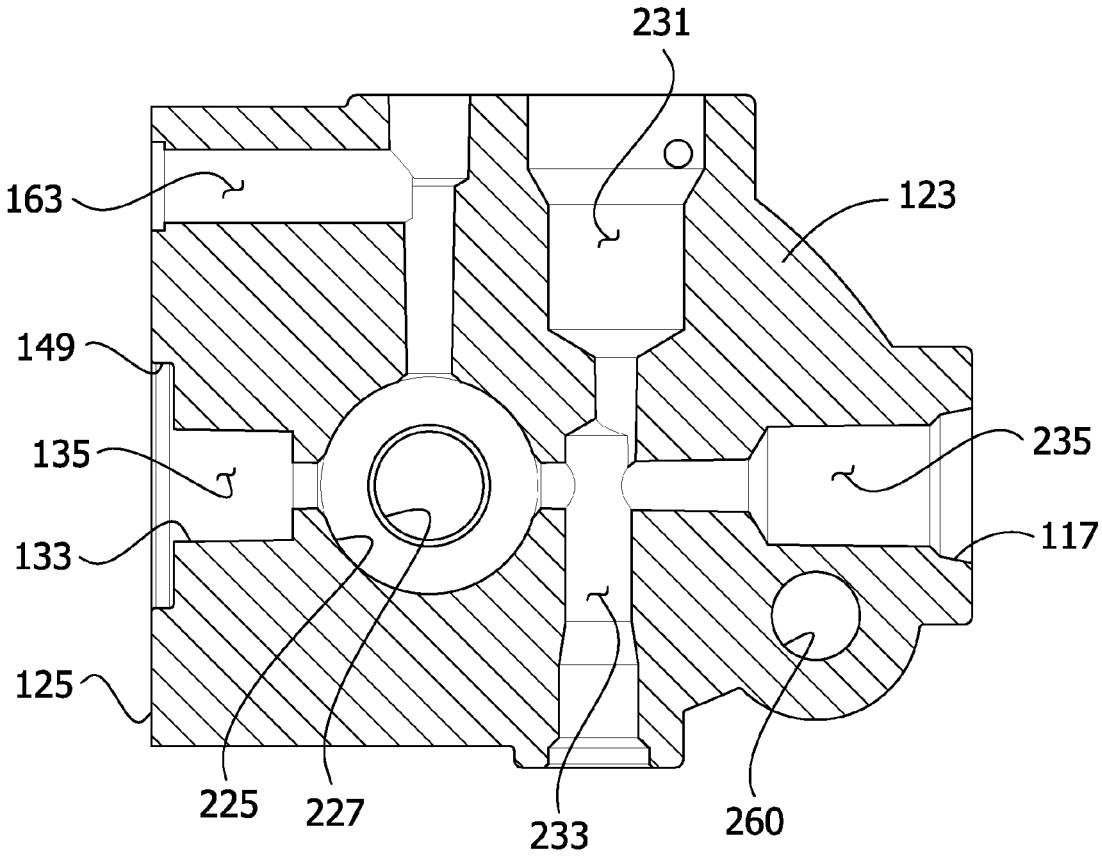
FIG. 9 is a section of the valve housing taken through a plane including line 9-9 in FIG. 7.

Referring to FIG. 8, the selector valve 115 comprises a valve body 221 and a stem 223 extending from the valve body. The valve body 221 is rotatable in an opening comprising a through-bore 225 extending through the valve housing 123 generally transverse to the longitudinal axis of the pump. The valve stem 223 is rotatable in an end portion 227 of the through-bore 225 (FIG. 9). A knob 229 is mounted on the valve stem 223 for rotating the stem and the valve body 221. Stops 271 on the valve housing 123 are received in respective grooves 273 in the inboard face of the knob 229 (FIG. 8A) for limiting rotation of the knob between positions corresponding to the stated negative-pressure and positive-pressure positions of the selector valve 115. Markings comprising an arrow 281 on the knob and position indicators (e.g., "pressure" and "vacuum"; not shown) on the valve housing are provided for indicating the two positions of the selector valve.

The valve housing 121 also includes a gauge opening 231, an exhaust port 233, the front and rear chamber passages 119, 121 and a flow passage 235 communicating with the outlet 117.

Figure 10:
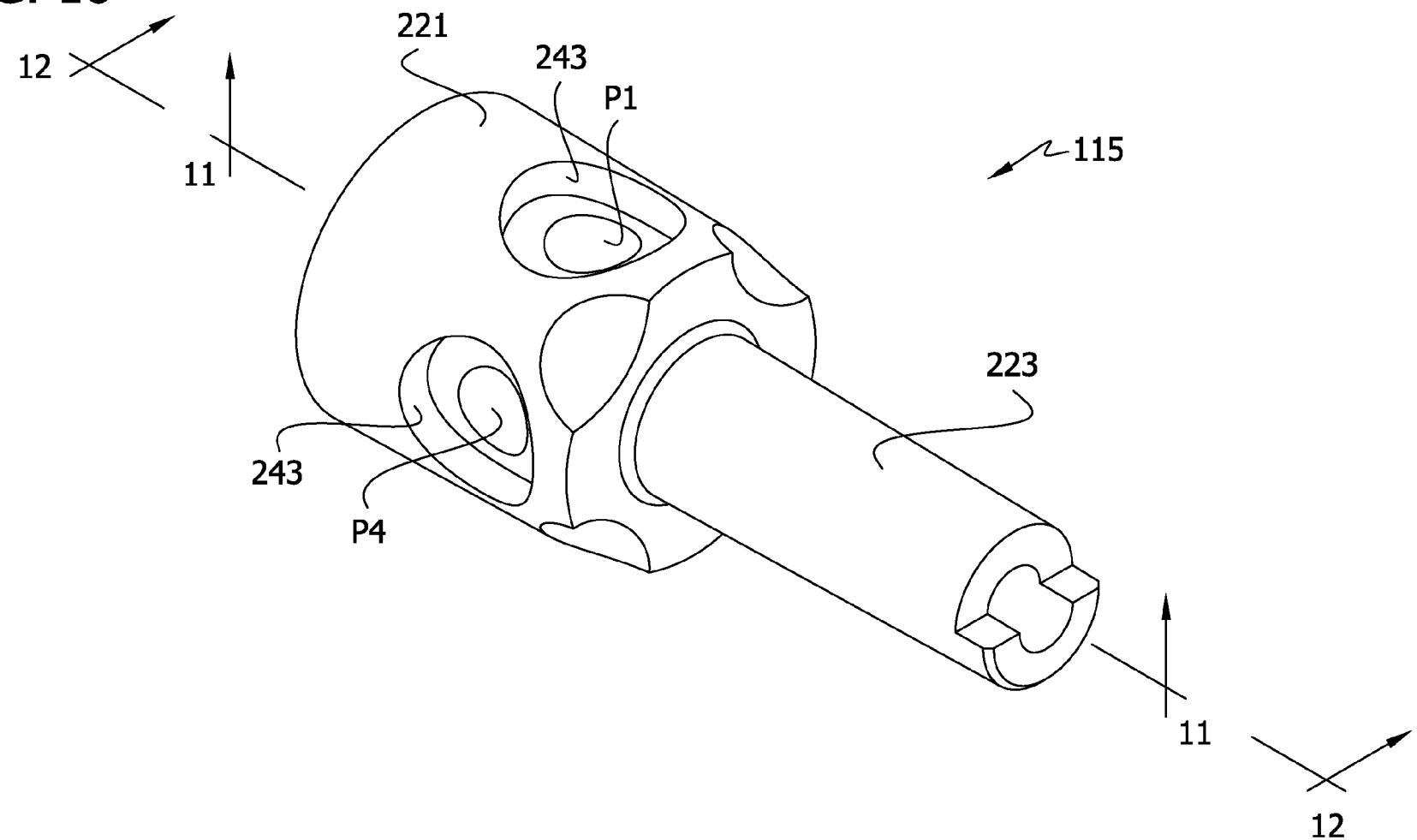
FIG. 10 is a perspective view of the selector valve.
Figure 11:
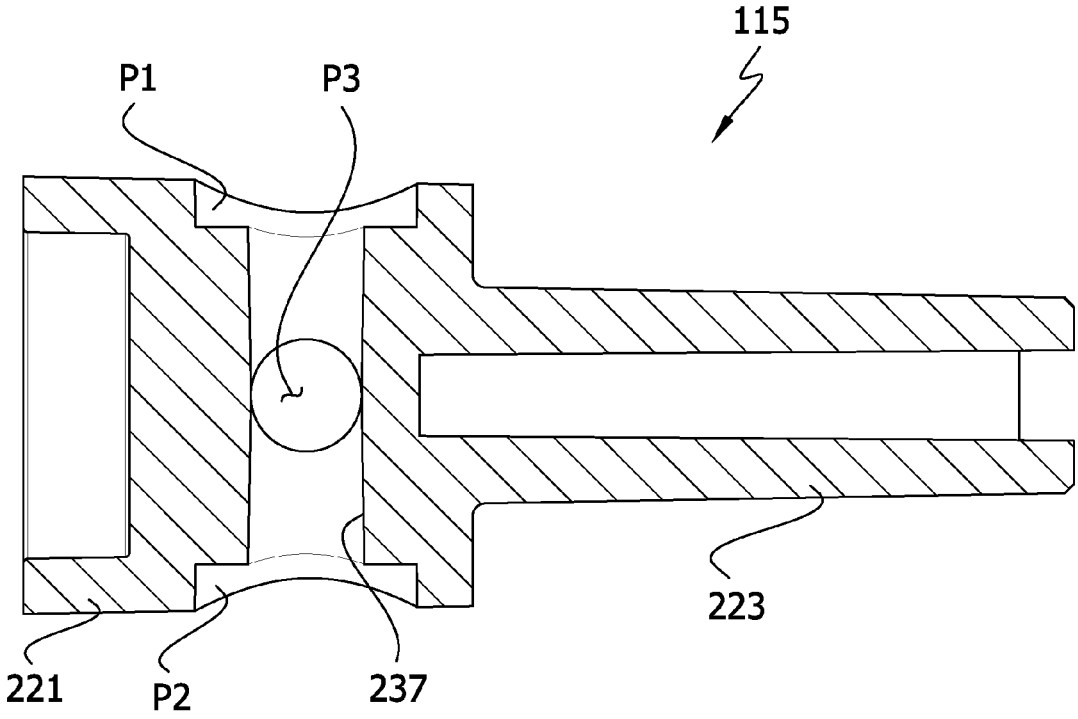
FIG. 11 is a section of the selector valve taken through a plane including line 11-11 in FIG. 10.
Figure 12:
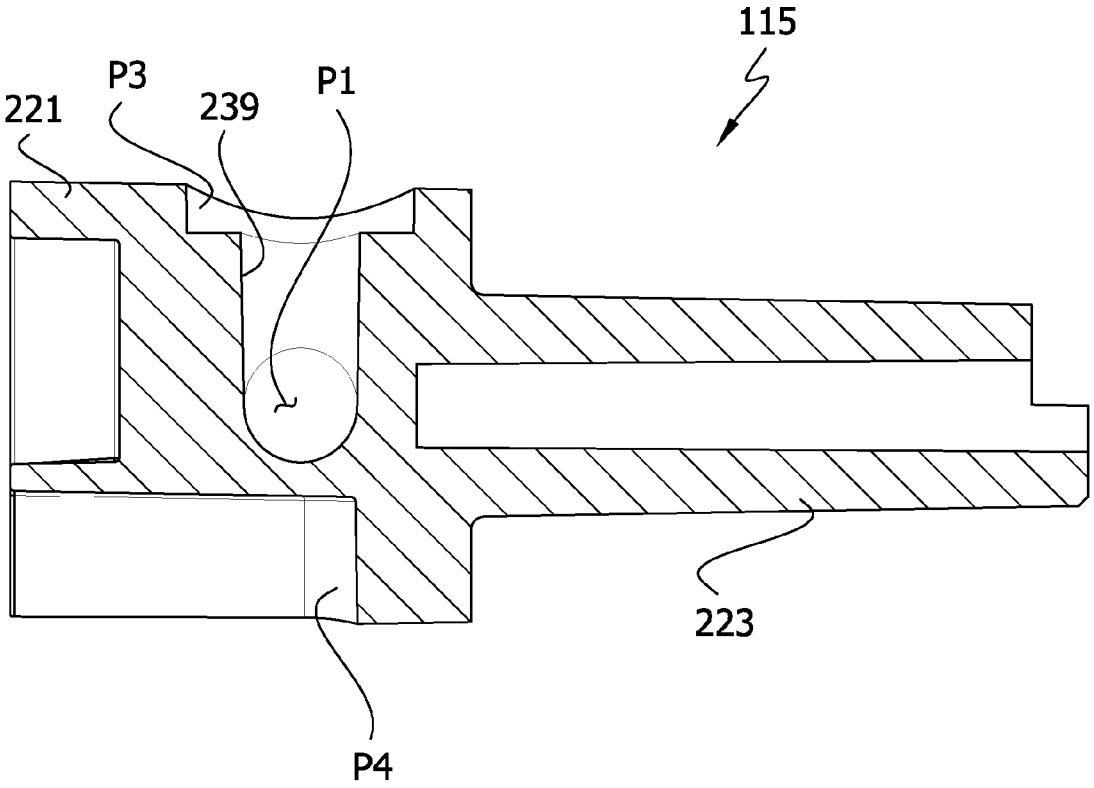
FIG. 12 is a section of the selector valve through a plane including line 12-12 in FIG. 10.

Referring to FIGS. 10-12, the valve body 221 of the selector valve 115 has four ports labeled P1 (first port), P2 (second port), P3 (third port) and P4 (fourth port) and can be rotated manually between its negative-pressure position and its positive-pressure position by turning the knob 229. Ports P1 and P2 communicate with one another by means of a first through-bore 237 in the valve body 221. Port P3 communicates with ports P1 and P2 by means of a second bore 239 in the valve body connected to the first bore 237. Port P4 does not communicate with ports P1, P2 and P3. When the selector valve 115 is in its negative-pressure position as shown in FIG. 4, port P1 communicates with the outlet 117 via the flow passage 235; port P2 communicates with the front chamber 119 of the cylinder 105 via the front chamber passage 135 in the valve housing 123 and the front passage opening 133 in the front wall 125 of the cylinder; port P3 is blocked; and port P4 communicates with atmosphere via an end portion 245 of the through-bore 225.

When the selector valve 115 is in its positive-pressure position as shown in FIG. 13, port P1 communicates with the rear chamber 121 via the rear chamber passage 163; port P2 is blocked; port P3 communicates with the outlet 117 via the flow passage 235 in the valve housing 123; port P4 communicates with atmosphere via the end portion 245 of the through-bore 225, and with the front chamber 119 via the front chamber passage 135 in the valve housing 123. Port seals 241 are provided in countersinks 243 (FIGS. 10-12) in the body 221 of the selector valve 115 to seal the connections between the ports P1, P2, P3 and respective passages 135, 163, 235.

Referring to FIGS. 4 and 8, a pressure release valve 251 is located in the exhaust port 233 in the valve housing 123. The valve 251 comprises a movable release valve member 253 and a seat 255. A pressure release lever 257 is pivotally connected to the valve housing 123 by a shaft 259 rotatable in an opening 260 in the valve housing 123. As will be described in more detail later, pivoting the lever 257 upwards lifts the release member 253 off the seat 255 to release pressure in the pump 101.

The pressure gauge 131 is received in the gauge opening 231 in the valve housing 123. The gauge opening 231 communicates with the outlet 117 via the flow passage 235. A wire pin 261 secures the pressure gauge 131 in the gauge opening 231. A hose connector 263 is attached in the outlet 117 to connect the hose 129 to the pump 101 for reading the pressure at the device 127.

A previously stated, the pump 101 is configured for operation in two settings. In the negative-pressure setting, the selector valve 115 is positioned in the orientation shown in FIG. 4 using the knob 229. In this setting, the actuator 109 is squeezed to pivot the pump handle 201 with respect to the hand grip 203, pulling the piston rod 111 rearward in the cylinder 105 and moving the piston 107 through a power stroke. As the handle 201 pivots down, the rod pin 211 slides up the ramp surfaces 213 at opposite sides of the slot 209 in the handle. The angle of the ramp surfaces 213 allows the piston rod 111 to remain generally co-axial with the cylinder 105 as the piston rod is pulled rearward. This design is in contrast to the fixed-pin connection shown in FIG. 1 of the prior pump, which causes the piston rod 111 to pivot downward when the piston 107 is pulled rearward, resulting in a substantial side load on the piston. An exhaust opening in the rear wall of the cylinder 5 of the prior pump accommodates the transverse movement of the piston rod 11.

As the piston 107 moves rearward in the cylinder 105, a suction is created which causes the dome check valve assembly 137 to open. Air is drawn in at the outlet 117 and travels into the front cylinder chamber 119 via the flow passage 235, ports P1 and P2, the front chamber passage 135, the front passage opening 133 and the port holes 151 in the valve seat 139. This air flow creates negative pressure at the outlet 117. The air in the rear chamber 121 exits through the rear passage opening 161 into the rear chamber passage 163. The air passes through the duckbill check valve 165 in the rear chamber passage 163. In the negative-pressure setting, the rear chamber passage 163 communicates with port P4 in the selector valve 115, causing the pump 101 to exhaust the air to atmosphere.

Upon release of the handle 201, the piston 107 moves back under the force of the spring 113 through a return stoke (toward the left in the drawings). The check valve 181 in the piston 107 opens to allow air trapped in the front chamber 119 to flow into the rear chamber 121. The positive pressure generated by the piston 107 in the front chamber 119 closes the dome check valve assembly 137 so air is not permitted to exit at the outlet 117. The air passing into the rear chamber 121 flows out of the rear passage opening 161, through the rear chamber passage 163 and out P4 in the selector valve to the atmosphere. This arrangement allows the pump 101 to build upon the negative pressure generated from a previous power stoke to steadily increase the negative pressure created at the outlet 117.

Figure 14:
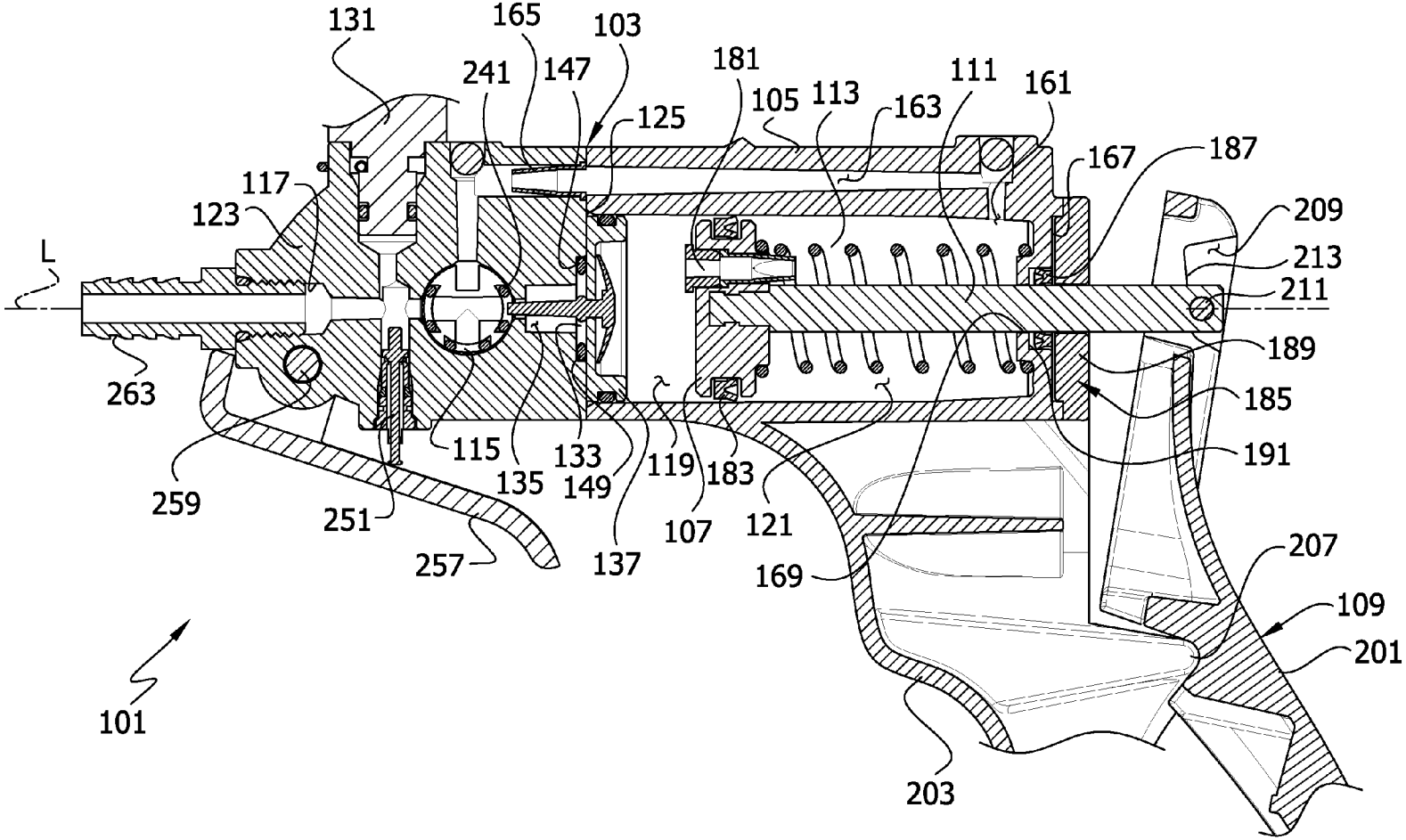
FIG. 14 is a section of the air pump in a negative-pressure setting and with the piston slightly retracted.
Figure 15:
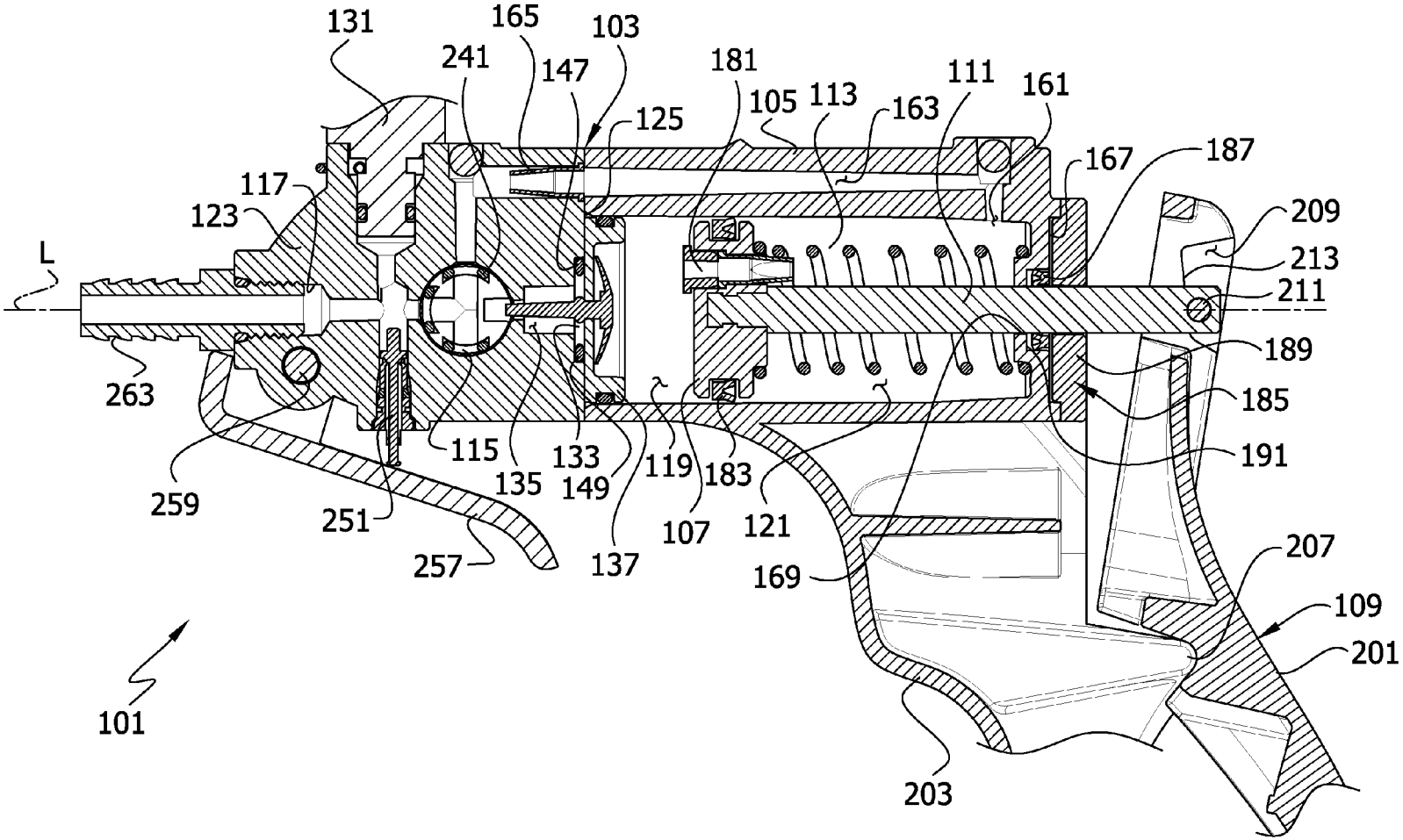
FIG. 15 is a section of the air pump in a positive-pressure setting and with the piston slightly retracted.

The pump may be changed from the negative-pressure setting of FIG. 14 to the positive-pressure setting of FIG. 15 by turning the knob 229 to rotate the selector valve 115 ninety degrees in the clockwise direction. In this setting, the actuator 109 is squeezed to pivot the pump handle 201 with respect to the hand grip 203, pulling the piston rod 111 and piston 107 rearward in the cylinder 105. As the handle 201 pivots down, the rod pin 211 slides up the ramp surfaces 213 at opposite sides of the slot 209 in the handle. The angle of the ramp 213 allows the piston rod 111 to remain generally co-axial with the cylinder 105 as the piston rod is pulled rearward.

As the piston 107 moves rearward in the cylinder 105 through a power stroke, the valve head 141 of the dome check valve assembly 137 opens and air is drawn through port P4 in the selector valve 115 into the front cylinder chamber 119 via the front passage opening 133 and the port holes 151 in the valve seat 137. The air in the rear chamber 121 is forced through the rear passage opening 161 into the rear chamber passage 163 through the duckbill check valve 165. In the positive-pressure setting, the rear chamber passage 163 communicates with the outlet 117 in the valve housing 123 via ports P1 and P3 causing the pump 101 to generate positive pressure at the outlet 117.

Upon release of the handle 201, the piston 107 moves back under the force of the spring 113 through a return stoke. The check valve 181 in the piston 107 opens to allow air trapped in the front chamber 119 to flow into the rear chamber 121. The positive pressure generated by the piston 107 closes the valve head 141 of the check valve assembly 137 so air is not permitted to exhaust to atmosphere. This arrangement allows the pump 101 to build upon the pressure generated from a previous power stoke to steadily increase the positive pressure generated at the outlet 117.

Pressure in pump 101 can be released at any time by pivoting the pressure release lever 257 upward to lift the release valve member 253 off the seat 255, thereby permitting air trapped between the device 127 and the pump 101 to be exhausted into the atmosphere through the exhaust port 233. Relieving the pressure enables a user to safely remove the pump 101 from the device 127.

Figure 16:
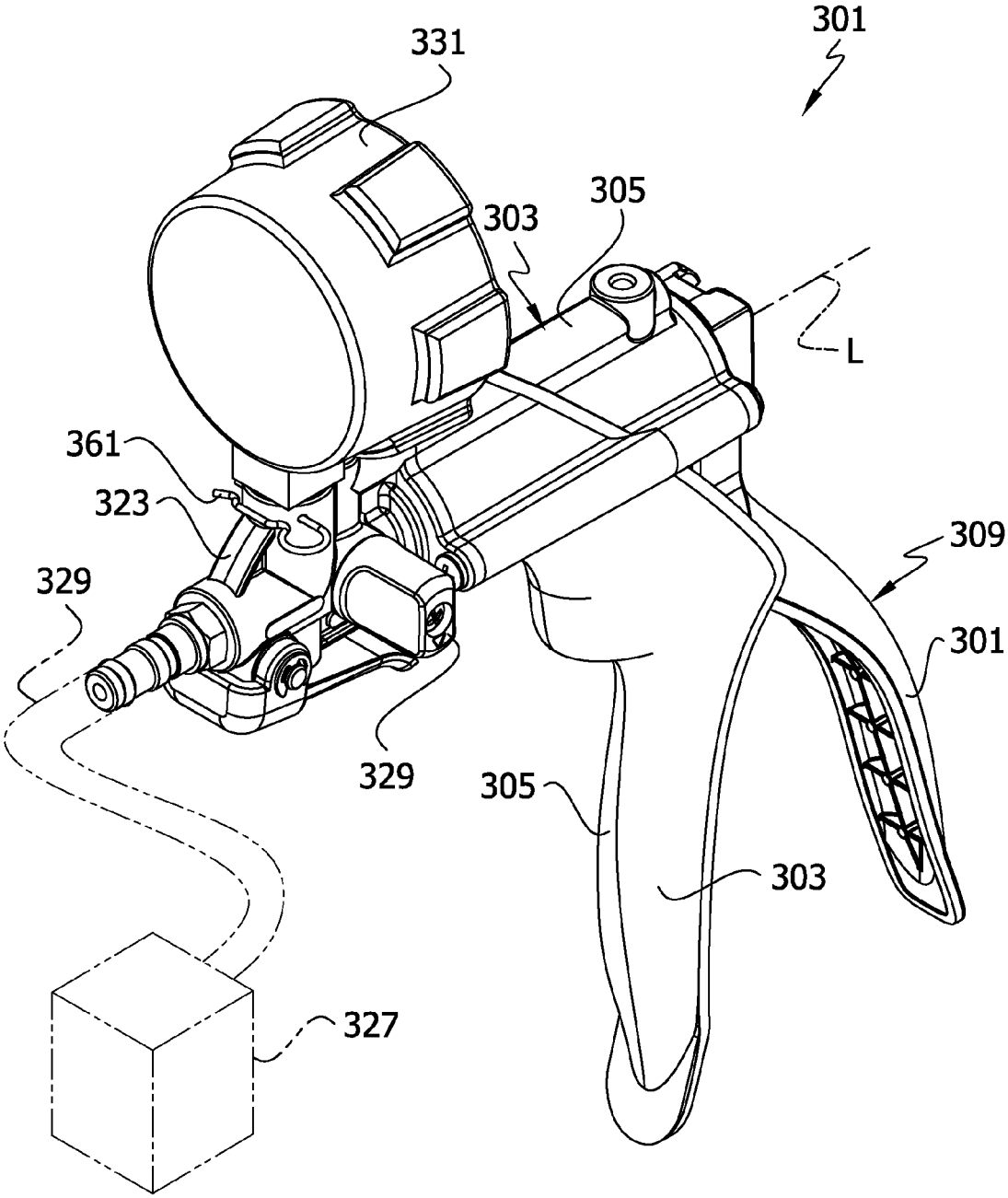
FIG. 16 is a perspective of a second embodiment of the air pump of this invention.
Figure 16A:
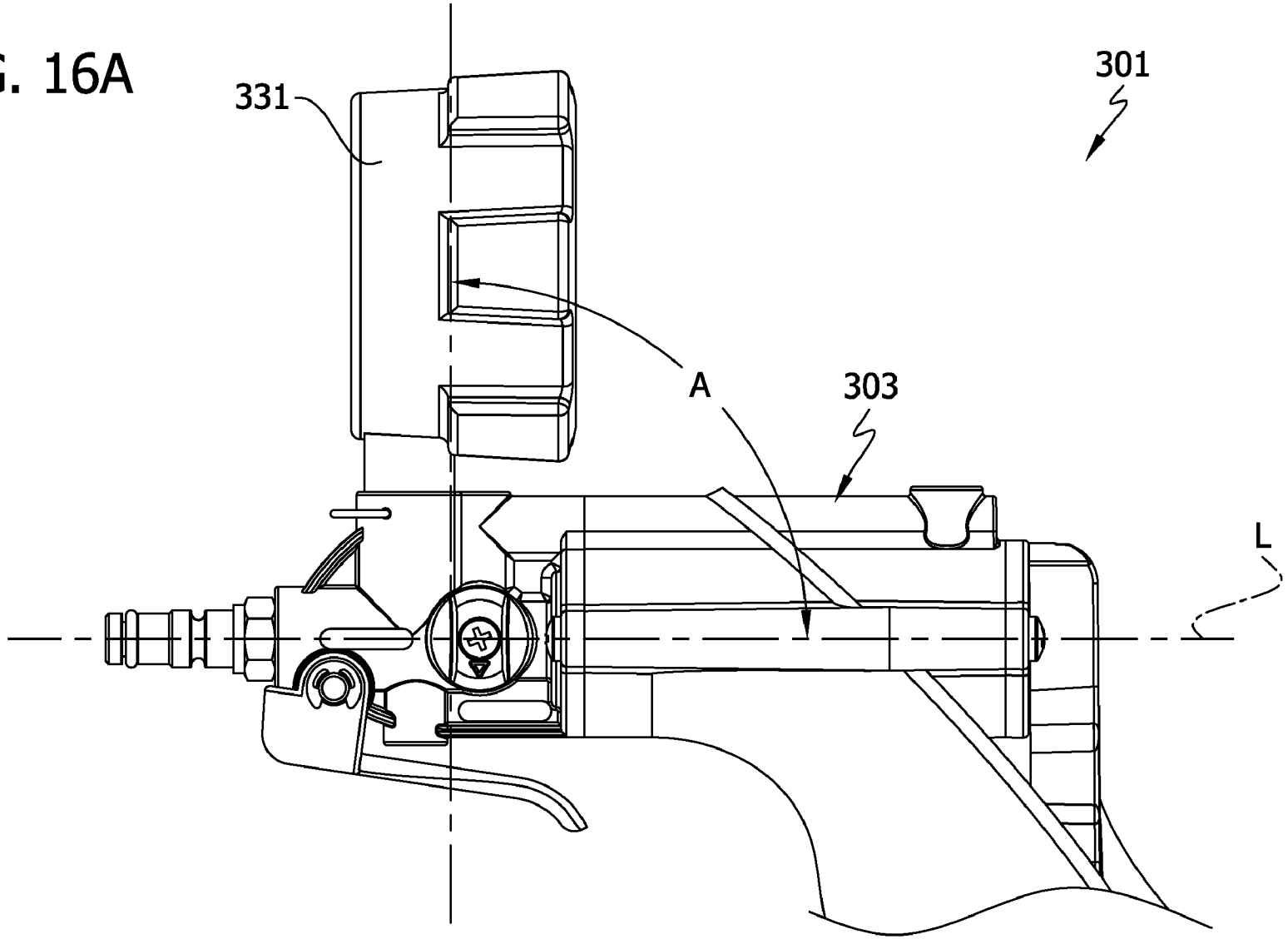
FIG. 16A is a side view of the second embodiment of the pump.

FIG. 16 illustrates a second embodiment of a pump 301. This pump 301 is substantially identical to the pump 101 of the first embodiment and corresponding parts are designated by corresponding reference numbers plus 200. In this embodiment, the pump gauge 331 is oriented at an angle A generally perpendicular to the longitudinal axis L of the pump body 303 (see FIG. 16A).

It will be observed from the foregoing that the hand pumps 101, 301 have several advantages. For example, both negative and positive pressures can be generated by moving the piston 107 through a power stroke by operation of the actuator 109. Thus, unlike the prior device in FIG. 1, the amount of positive pressure developed is not limited by the force of the spring 113 moving the piston through its return stroke. Also, the relative movement between the piston rod 111 and the handle 201 as permitted by the slot 209 during operation of the actuator reduces any side loads on the back cup seal 187 and piston 107.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including"

and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A hand operated pump for generating negative and positive air pressure, said pump comprising:

a pump body including a pump cylinder;

a piston mounted for reciprocation in the pump cylinder;

a piston rod connected to the piston and extending rearward from the piston in the pump cylinder;

an actuator operatively connected to the piston rod for moving the piston in the pump cylinder through a power stroke, the piston thereafter being movable through a return stroke prior to another power stroke;

a selector valve in the pump body communicating with the pump cylinder and moveable between a positive-pressure position and a negative-pressure position; and an outlet in the pump body communicating with the selector valve for applying said negative and positive air pressure to a device in response to operation of the actuator;

the selector valve communicating with a front chamber in front of the piston and a rear chamber behind the piston such that operation of the actuator to move the piston through said power stroke when the selector valve is in the negative-pressure position causes the pump to generate negative pressure at said outlet, and operation of the actuator to move the piston through said power stroke when the selector valve is in the positive-pressure position causes the pump to generate positive pressure at said outlet;

wherein movement of the piston through said return stroke when the selector valve is in the negative-pressure position does not cause the pump to generate negative pressure at said outlet.

2. The pump as set forth in claim 1 wherein the selector valve communicates with the front chamber via a front chamber passage and with the rear chamber via a rear chamber passage.

3. The pump as set forth in claim 2 wherein when said selector valve is in the negative-pressure position and the piston is moved through the power stroke, air flows in from the outlet, through the selector valve and through the front chamber passage into the front chamber of the pump cylinder thereby generating negative pressure at the outlet, and air is exhausted from the rear chamber of the pump cylinder through the rear chamber passage.

4. The pump as set forth in claim 3 wherein when said selector valve is in the positive-pressure position and the piston is moved through the power stroke, air flows out of the rear chamber of the pump cylinder through the rear chamber passage, through the selector valve and out the outlet thereby generating positive pressure at the outlet.

5. The pump as set forth in claim 1 further comprising an exhaust port communicating with the pump outlet and selector valve, and a pressure release valve in the exhaust port and movable from a closed position in which the exhaust port is closed and an open position in which the exhaust port is open to relieve pressure at said pump outlet and in the pump.

6. The pump as set forth in claim 5 wherein said pump body further comprises a valve housing containing said selector valve, exhaust port and pump outlet.

7. The pump as set forth in claim 6 further comprising a hand-operated lever mounted on said valve housing for moving the release valve from its closed position to its open position.

8. The pump as set forth in claim 1 further comprising a pressure gauge communicating with the outlet for reading the pressure generated by the pump.

9. The pump as set forth in claim 8 wherein the pressure gauge is mounted such that the pressure gauge is oriented at an obtuse angle relative to a longitudinal axis of the pump body.

10. The pump as set forth in claim 1 wherein said actuator comprises a handle mounted for pivoting movement on the pump body, and a recess in the handle receiving a back end of the piston rod, the recess permitting relative movement between the handle and the piston rod when the handle is operated.

11. The pump as set forth in claim 10 wherein said recess comprises a vertical slot in the handle generally adjacent an upper end of the handle, said piston rod extending through the slot, and a pin on the piston rod in contact with ramp surfaces on opposite sides of the slot, said ramp surfaces being movable relative to the pin when the handle is operated.

12. A method of operating a hand pump to generate both negative and positive air pressure, said pump comprising a pump body including a pump cylinder, a piston mounted for reciprocation in the pump cylinder, a selector valve in the pump body communicating with the pump cylinder and movable between a positive-pressure position and a negative-pressure position, and an outlet in the pump body, said method comprising:

moving the selector valve to said negative-pressure position and then hand-operating an actuator of the pump to move the piston in the pump cylinder through a power stroke to generate a negative air pressure at the outlet, the piston thereafter being movable through a return stroke prior to another power stroke, wherein movement of the piston through said return stroke does not generate negative air pressure at the outlet; and moving the selector valve to said positive-pressure position and then hand-operating the actuator of the pump to move the piston in the pump cylinder through said power stroke to generate a positive air pressure at the outlet, the piston thereafter being movable through said return stroke prior to said another power stroke.

13. The method as set forth in claim 12 wherein said piston is moved through said return stroke by a spring.

14. A hand operated pump for generating negative and positive air pressure, said pump comprising:

a pump body including a pump cylinder;

a piston mounted for reciprocation in the pump cylinder;

a piston rod connected to the piston and extending rearward from the piston in the pump cylinder;

an actuator operatively connected to the piston rod for moving the piston in the pump cylinder through a power stroke, the piston thereafter being movable through a return stroke prior to another power stroke;

a selector valve in the pump body communicating with the pump cylinder and moveable between a positive-pressure position and a negative-pressure position;

an outlet in the pump body communicating with the selector valve for applying said negative and positive air pressure to a device in response to operation of the actuator;

the selector valve communicating with a front chamber in front of the piston and a rear chamber behind the piston such that operation of the actuator to move the piston through said power stroke when the selector valve is in the negative-pressure position causes the pump to generate negative pressure at said outlet, and operation of the actuator to move the piston through said power stroke when the selector valve is in the positive-pressure position causes the pump to generate positive pressure at said outlet; and a check valve permitting air to pass into the rear chamber when the piston moves through the return stroke.

15. The pump as set forth in claim 14 wherein said piston rod passes through an opening in a rear wall of the pump cylinder, and further comprising a seal around the piston rod for sealing the opening against the passage of air through the opening during the power stroke of the piston.

16. The pump as set forth in claim 14 wherein the check valve is received in an opening in the piston.

17. A hand operated pump for generating negative and positive air pressure, said pump comprising:

a pump body including a pump cylinder;

a piston mounted for reciprocation in the pump cylinder;

a piston rod connected to the piston and extending rearward from the piston in the pump cylinder;

an actuator operatively connected to the piston rod for moving the piston in the pump cylinder through a power stroke, the piston thereafter being movable through a return stroke prior to another power stroke;

a selector valve in the pump body communicating with the pump cylinder and moveable between a positive-pressure position and a negative-pressure position; and an outlet in the pump body communicating with the selector valve for applying said negative and positive air pressure to a device in response to operation of the actuator;

the selector valve communicating with a front chamber in front of the piston and a rear chamber behind the piston such that operation of the actuator to move the piston through said power stroke when the selector valve is in the negative-pressure position causes the pump to generate negative pressure at said outlet, and operation of the actuator to move the piston through said power stroke when the selector valve is in the positive-pressure position causes the pump to generate positive pressure at said outlet;

said selector valve comprising a first port, a second port, a third port, and a fourth port, said fourth port being in communication with atmosphere but not in communication with the first, second, and third ports, said selector valve being configured such that when the selector valve is in said positive-pressure position, the first port communicates with the rear chamber, the second port is blocked, the third port communicates with the outlet, and the fourth port communicates with atmosphere, and such that when the selector valve is in said negative-pressure position, the first port communicates with the outlet, the second port communicates with the front chamber, the third port is blocked, and the fourth port communicates with atmosphere.

18. The pump as set forth in claim 17 wherein said first, second, and third ports are in communication with one another.

* * * * *